US006755426B2

(12) United States Patent
Yvars et al.

(10) Patent No.: US 6,755,426 B2
(45) Date of Patent: Jun. 29, 2004

(54) SNOWBOARDING BOOT

(75) Inventors: Nicolas Yvars, Meylan (FR); Pierre Gignoux, Coublevie (FR); Jean-Marc Pascal, Voreppe (FR)

(73) Assignee: Skis Rossignol S.A., Vorion (FR)

( * ) Notice: Subject to any disclaimer, the term of this patent is extended or adjusted under 35 U.S.C. 154(b) by 0 days.

(21) Appl. No.: 09/884,382

(22) Filed: Jun. 19, 2001

(65) Prior Publication Data

US 2002/0030349 A1 Mar. 14, 2002

(30) Foreign Application Priority Data

Jun. 19, 2000 (FR) ..... 00 07780

(51) Int. Cl.[7] ..... B62B 9/04

(52) U.S. Cl. ..... 280/14.22; 280/11.3; 280/611; 280/613; 280/14.21

(58) Field of Search ..... 280/611, 613, 280/614, 623, 624, 634, 14.21, 14.22, 14.24, 617, 618; 36/117.1, 117.3, 132

(56) References Cited

U.S. PATENT DOCUMENTS

| | | | | | |
|---|---|---|---|---|---|
| 3,764,154 | A | * | 10/1973 | Witting | 280/618 |
| 3,834,723 | A | * | 9/1974 | Erlebach | 280/613 |
| 3,902,729 | A | * | 9/1975 | Druss | 280/613 |
| 3,917,298 | A | * | 11/1975 | Haff | 280/607 |
| 3,957,280 | A | * | 5/1976 | Turnheim et al. | 280/613 |
| 4,185,851 | A | * | 1/1980 | Salomon | 280/613 |
| 4,499,674 | A | * | 2/1985 | Olivieri | 36/117.3 |
| 4,571,858 | A | * | 2/1986 | Faulin | 36/117.4 |
| 4,611,414 | A | * | 9/1986 | Vogel | 36/118.3 |
| 4,718,181 | A | * | 1/1988 | Olivieri | 36/118.1 |
| 5,054,213 | A | * | 10/1991 | Bonaventure | 36/117.3 |
| 5,188,386 | A | * | 2/1993 | Schweizer | 280/607 |
| 5,214,865 | A | | 6/1993 | Sartor | 36/117 |
| 5,669,630 | A | * | 9/1997 | Perkins et al. | 280/623 |
| 5,909,894 | A | * | 6/1999 | Meader et al. | 280/623 |
| 5,971,419 | A | * | 10/1999 | Knapschafer | 280/607 |
| 6,010,138 | A | * | 1/2000 | Bobrowicz et al. | 280/11.36 |
| 6,062,586 | A | * | 5/2000 | Korman | 280/613 |
| 6,142,503 | A | * | 11/2000 | Forest et al. | 280/624 |
| 6,168,173 | B1 | * | 1/2001 | Reuss et al. | 280/14.24 |
| 6,328,328 | B1 | * | 12/2001 | Finiel | 280/636 |
| 6,331,007 | B1 | * | 12/2001 | Bryce | 280/11.3 |

FOREIGN PATENT DOCUMENTS

| | | |
|---|---|---|
| DE | G 88 15 173.5 | 9/1989 |
| FR | 2 734 167 | 5/1995 |
| WO | WO 97/22390 | 6/1997 |
| WO | WO 97/27773 | 8/1997 |

* cited by examiner

*Primary Examiner*—Brian L. Johnson
*Assistant Examiner*—Kelly E Campbell
(74) *Attorney, Agent, or Firm*—Heslin Rothenberg Farley & Mesiti P.C.; Victor A. Cardona, Esq.

(57) ABSTRACT

A snowboarding boot includes a sole assembly having an outsole with a the lower face for contacting a ground surface and a reinforcing piece. Further included is a transverse plate for interaction with complementary arrangements of a binding. The plate is mechanically integrated with the sole assembly. An elastic element is interposed between the plate and the sole assembly. The element is deformable to allow lateral deflection of the boot relative to the binding.

18 Claims, 6 Drawing Sheets

SNOWBOARDING BOOT

CROSS REFERENCE TO RELATED APPLICATIONS

This application claims priority from French application 00 07780, filed Jun. 19, 2000.

TECHNICAL FIELD

The invention relates to the field of sports which involve sliding. More specifically, it relates to a boot intended for snowboarding. It relates more particularly to the connection between the boot and the means which, on the boot, interact with the binding.

PRIOR ART

In a known manner, snowboarding boots can be, depending on the type of snowboarding practiced, either hard after the fashion of a ski boot, or soft. The invention relates in particular, but not exclusively, to this second family.

This type of boot generally comprises a flexible upper which is relatively deformable so as to allow leg movements and to be comfortable. This upper is associated with a sole assembly which comprises in particular an outsole which is relatively flexible and deformable so as to allow a good rolling movement of the foot during walking motion. This sole assembly also comprises means for interaction with complementary arrangements of the binding. These interaction means are anchored mechanically in this sole assembly and in particular in a reinforcing piece associated with the sole.

A great many types of interaction means exist, the geometry and the design of which depend on the type of binding used. Thus, some bindings interact with the boot in the region of a spindle or a transverse plate which protrudes on each side of the boot. In other standards, the binding interacts with inserts located on both sides of the sole. In systems which are different again, the binding can comprise jaws which render captive a projection located under the sole of the boot.

The sole assembly, and in particular the reinforcing piece in which the means for interaction with the binding are anchored, clearly depends on the nature of these means. This reinforcing piece can be located inside the boot, above the outsole, and take the form of a frame receiving the foot. This reinforcing piece can also have smaller dimensions and form a plate which can, if appropriate, be embedded inside the outsole, or accommodated in a housing provided for this purpose in the outsole.

This anchorage creates a rigid mechanical connection allowing the effective transmission of forces from the foot of the user to the snowboard. The interaction means of the boot and the binding are attached at at least two points or two contact zones, so that the boot is completely mechanically integrated with the board when the binding is engaged. This integration makes possible very good transmission of the forces necessary for steering. However, this firm, permanent attachment prevents lateral deflection movements of the boot. It is of course known that in certain types of snowboarding, in particular freestyle, the position of the user changes continuously in relation to the board and the inclination of the leg is consequently adjusted. The firm, permanent attachment of the boot to the board therefore limits the possibilities of inclination of the leg, and therefore the suitability of the board for freestyle snowboarding.

One problem which the invention therefore aims to solve is that of facilitating lateral inclination of the leg while ensuring effective, rigid attachment of the boot to the binding.

Analyzed more specifically, the behavior sought is that observed with a strap binding, the foot being capable of orienting itself inside the binding following a rolling motion resulting from the deformation of the sole assembly combined with pivoting. This allows the foot to receive the sensations originating from the board over a relatively large surface area. In other words, it is important that this rolling motion of the foot does not take place to the detriment of the ease of attachment of the boot to the binding.

In other words, another problem which the invention seeks to solve is that of reconciling the rolling motion capacity with a firm, easy attachment of the boot to the binding of automatic type.

A number of solutions have already been proposed to afford a degree of freedom to the connection between the boot and the board.

Thus, document U.S. Pat. No. 5,971,419 describes a binding comprising two elements, namely a baseplate integrated with the binding and a platform mounted on this baseplate. This platform is connected to the baseplate via a longitudinal articulation spindle allowing lateral deflections of the platform, and therefore of the boot which it receives. This binding has numerous disadvantages. In fact, owing to its design, this binding functions only for hard boots. Furthermore, only that portion of the sole of the foot located vertically in relation to the articulation spindle can exert bearing forces, which results in a loss of sensation. Moreover, this binding holds the foot relatively far from the board. More specifically, the boot pivots about an axis which is located under the sole. For optimum performance, however, it is desirable rather to maintain permanent bearing.

A similar solution is described in document DE-U-88 15173.5. Such a device includes, between the baseplate and the pivoting platform, a layer of compressible material providing damping of the lateral deflection. This solution has the major disadvantage of requiring a large number of mechanical pieces which increase the cost of the binding and the risks of mechanical failure. Moreover, such a binding is not arranged so as to hold the boot captively by automatic fitting of the boot into the binding, but on the contrary requires manual actions on the part of the user.

Document FR 2 734 167 also contains a proposal for a binding of a particular type which interacts with the boot on only one side of the latter. In this way, the boot has a capacity for relative movement in relation to the board about an orientation axis lying in the longitudinal direction of the boot. Owing to its asymmetry, this device favors the transmission of forces on only one side of the boot, which is a handicap for certain types of snowboarding. Moreover, in order to avoid that side of the boot which is not integrated with the board lifting excessively, it is necessary for the sole to be sufficiently rigid, which compromises walking comfort.

Finally, as the attachment in relation to the binding is effected on only one side of the boot, the mechanical stresses exerted in the region of such an attachment are particularly great, which increases the risks of the means for interaction with the binding being pulled out.

Furthermore, document WO 97/27773 describes a snowboarding boot, the sole of which comprises means for interaction with the binding consisting of two spindles located along the longitudinal median plane of the boot. These longitudinal spindles are held captively by complementary jaws of the binding. The peripheral zone of the sole of this boot consists of compressible material. Thus, when the user wishes to tilt his leg laterally, the sole pivots about the spindles for interaction with the binding, and the compressible zone is crushed. This boot has the disadvantage of exposing the compressible zone to contact with the ground when the boot is used for walking. This results in accelerated wear of this compressible zone which is made of a material which is not very resistant to abrasion. After wear of this material, the boot no longer bears laterally on the board, and therefore pivots freely in relation to the longitudinal spindles, thus inducing a sensation of instability. Moreover, the lateral deflection capacity of such a boot is difficult to regulate, as it depends virtually exclusively on the thickness of the compressible peripheral zone.

A problem which the invention aims to solve is that of allowing lateral deflection of the boot in relation to the binding or a possibility of rolling while providing firm, effective holding of the boot in relation to the board, and while allowing automatic fitting of the boot into the binding.

DISCLOSURE OF THE INVENTION

The invention therefore relates to a snowboarding boot which comprises:

- a sole assembly comprising in particular:
  - an outsole, the lower face of which is intended to come into contact with the ground;
  - a reinforcing piece;
- means for interaction with complementary arrangements of the binding, said means being mechanically integrated with the sole assembly.

This boot is characterized in that it comprises an element made of a material having elastic properties interposed between the interaction means and the sole assembly, said element being capable of being deformed in order to allow lateral deflection or a rolling motion of the boot in relation to the binding.

In other words, the means for interaction with the binding are connected to the rigid part of the boot by an elastic connection which allows slight relative displacement of these means in relation to the boot, and therefore of the boot in relation to the binding and the board. Thus, while maintaining firm, permanent attachment of the boot to the binding, the user benefits from an additional degree of freedom allowing the rolling motion of the boot in relation to the binding. This additional degree of freedom is afforded by the structure itself of the boot, in contrast to the systems of the prior art, in which any degrees of freedom result from the configuration of the interface between the boot and the binding.

In practice, the deformation of the elastic element takes place by compression or tension in a vertical direction, and by shear in a horizontal plane. The combination of these two deformations of different type makes it possible to obtain the rolling motion sought, which is favorable for good perception of sensations. By an abuse of language, this movement is described as "rolling". This motion results in a different vertical displacement of the two lateral ridges of the boot, possibly with a slight transverse translation.

In practice, the means for interaction with the binding can advantageously be anchored in the reinforcing piece.

According to the design of the interaction means, the elastic element can consist either of a zone of the outsole or of a supplementary element interposed between the sole assembly and the interaction means.

Thus, in the first case, the means for interaction with the binding are positioned in a recess of the sole, and that portion of the sole comprised between the reinforcing piece and the interaction means serves as an elastic element. The outsole then has sufficient flexibility to be deformed under the action of the forces exerted by the user.

In the second case, the interaction means are positioned under an additional element which is itself arranged under or on the sides of the outsole.

According to another characteristic of the invention, the boot can moreover comprise means capable of limiting the displacement of the interaction means in relation to the sole assembly.

In other words, the amplitude of movements of the interaction means is limited, which proves to be useful during fitting of the boot into the binding. In fact, when the user engages his boot in the binding, he exerts a downwardly oriented vertical force which tends to deform the elastic element. If this elastic element is deformed excessively, the engagement of the interaction means in the complementary arrangements of the binding could prove to be difficult or even impossible in some cases. Thus, in certain geometries, the means of limiting the displacement of the interaction means allow optimum, automatic fitting of the boot into the binding.

By selecting an elastic element made of a number of materials, it is possible to favor the deformations of the element in certain directions. The compression or the stretching of the elastic element is therefore different from one side to the other of the boot. Thus, when the elastic element is asymmetric, deflection of the boot on one side of the boot is facilitated in relation to the other.

It is likewise possible to bring about asymmetric behavior by adapting the geometry of the different means of the boot. Thus, it is possible to provide travel limiters which are different from one side to the other of the boot. These limiters can advantageously be adjustable. Deflection on one side of the boot is thus favored in relation to the other.

According to another characteristic of the invention, the boot can likewise comprise means which are capable of bringing about pivoting of the interaction means in relation to the reinforcing piece. In other words, deformation of the elastic element is favored in a specific direction, and in particular that which leads to lateral inclination of the leg. Thus, the elastic element is forced to be deformed depending on the pivoting movement of the interaction means. Moreover, the pivoting means bring about direct transmission of the forces exerted vertically which are not intended to induce an inclination of the leg. With regard to these forces, it is thus possible to avoid stressing the elastic element.

In practice, the element interposed between the reinforcing piece and the interaction means can advantageously have viscoelastic properties making it possible to favor slow deformations while remaining snappy at the time of rapid deformations. Moreover, this element thus absorbs some of the vibrations being transmitted from the board in the direction of the remainder of the boot.

As mentioned already, a great many types of interaction means exist, very many of which can be used for a boot according to the invention.

Thus, in a first family of variants, the interaction means can comprise a transverse spindle, the ends of which are intended to be held captively by jaws of the binding. In this case, the boot can comprise a plate covering the transverse spindle to hold the transverse spindle under the outsole. In this case, the plate is integrated with the reinforcing piece by connection means.

In practice, the plate can advantageously slide in relation to these connection means so as to allow, but also to limit, the displacement of the interaction means in relation to the reinforcing piece and therefore the bottom of the outsole.

In order to allow pivoting of the boot in relation to the transverse spindle, said spindle can comprise an enlargement which comes into contact with the plate, thus allowing the spindle to pivot in relation to the plate and therefore in relation to the reinforcing element.

The boot according to the invention can comprise another type of interaction means consisting of a transverse plate, the ends of which are intended to be held captively by the binding.

Advantageously, the boot can then comprise connection means extending through the plate, which are anchored in the reinforcing piece and which thus allow the plate to slide in relation to the connection means. This plate can be displaced in relation to the reinforcing piece according to different modes of operation. Thus, under the action of a force exerted downwardly, the material interposed between the plate and the outsole works under compression. On the other hand, under the action of a force exerted upwardly, this same material works under tension.

The invention can also be adapted to another type of interaction means, which means comprise two inserts forming a cavity, which are each arranged on one side of the boot and are intended to receive arrangements of the binding, each insert being accommodated in a housing formed in the element made of a material having elastic properties, said element itself being accommodated in the outsole.

In this case, the binding comprises levers, a part of which comes to be received in the inserts on each side of the boot. These inserts are mounted inside the thickness of the outsole and are connected to the latter by the characteristic elastic element. These inserts therefore have a certain capacity for displacement inside the elastic element, which therefore allows lateral deflection of the boot.

In practice, the elastic element can itself advantageously be accommodated in a seat which is itself integrated with the reinforcing piece. In this case, the two seats, each receiving a lateral insert, are integrated with one another, which makes it possible to avoid excessive deformation of the sole and to improve the stability and the interaction with the binding.

The boots according to the invention can also receive another type of interaction means consisting of a projection located under the sole and intended to be held captively by arrangements of the binding, such as jaws. In this case, the projection can be, for example, mounted directly in a recess under the sole, which comprises directly in line with the projection a zone made of elastic material constituting the characteristic elastic connection. The boot can likewise receive a complete elastic projection which is positioned in a housing under the sole between the outsole and the characteristic projection.

Advantageously, it is possible to provide connection means extending through the projection and anchored in the reinforcing piece while passing through the element made of material having elastic properties so as to allow sliding of the projection in relation to the connection means.

The invention is not limited only to the types of interaction means described above but also covers solutions in which the binding interacts with the boot in the region of a number of points on each side of the boot. It is thus possible to provide two (or more) spindles or transverse plates, or two (or more) lateral inserts on each side of the boot.

BRIEF DESCRIPTION OF THE FIGURES

The way the invention is embodied and also the advantages deriving therefrom will emerge clearly from the description of the embodiments below, based on the accompanying figures, in which.

MODES FOR EMBODYING THE INVENTION

Figure 1:
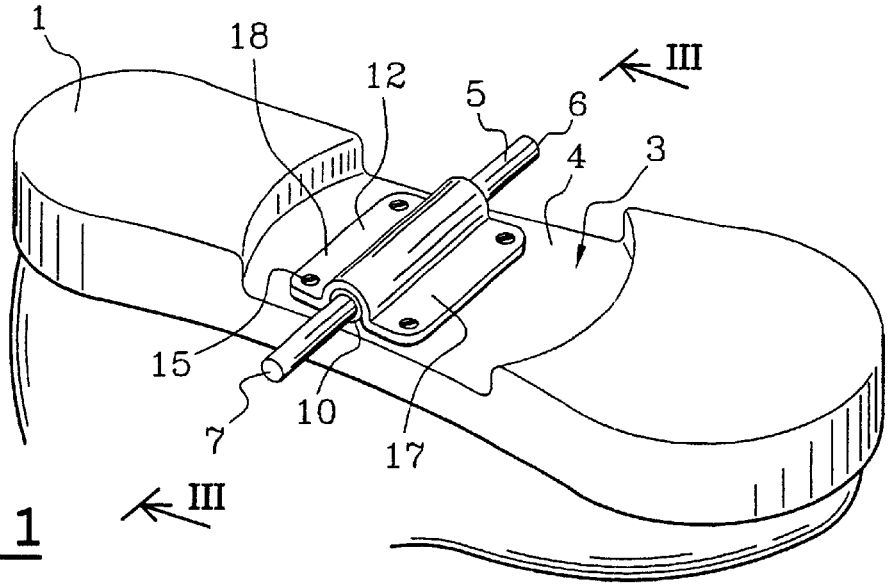
FIG. 1 is a basic perspective view of the sole of a boot including a transverse spindle for interaction with the binding.

As already mentioned, the invention relates to a snowboarding boot, the means of which for interaction with the binding are connected to the sole assembly (1), and more particularly to a reinforcing piece (2) associated with the sole, by virtue of an elastic connection allowing lateral deflection of the boot. The principle of the invention can be applied to boots which have very different interaction means, each corresponding to different types of binding.

All the variants described below therefore use the principle of the invention which consists in interposing an elastic element between the interaction means and the rigid part of the sole via which the bearing forces are transmitted.

First Mode of Embodying the Invention

FIGS. 1 to 4 describe a boot equipped with a first type of interaction means, in the form of a transverse spindle (5). This transverse spindle (5) is arranged in the median region of the boot, in the clearance (3) of the sole. The ends (6, 7) of the spindle protrude laterally and are held captively by jaws or hooks (not shown) of the binding. These ends (6, 7) are located at a fixed level in relation to the board, so that the transverse spindle (5) is held immobile in relation to the binding and therefore the board.

This cylindrical spindle (5) consists of a metal bar with a diameter of around 10 millimeters. According to the invention, this bar (5) is sheathed by a tube (10) made of elastic or even viscoelastic material with a thickness of around a few millimeters or even a centimeter. The bar (5) and the elastic sheath (10) are kept integrated with the boot by a plate (12). This plate (12) has in its central region a transverse channel (13) intended to receive the transverse spindle (5). The width of the channel (13) is slightly greater than the diameter of the transverse spindle (5) and the elastic sheath (10). This plate (12) extends over a substantial part of the width of the sole (1) in the zone in which it is installed. Nevertheless, in variants which are not shown, this plate could be replaced by several independent elements located side by side.

The plate (12) is integrated with the sole (1), more specifically with the reinforcing piece (2), by means of four fixing screws (15). These screws can be added at the time the spindle (5) is mounted, or can be replaced by extensions forming an integral part of the reinforcing piece (2) located inside the boot.

Figure 2:
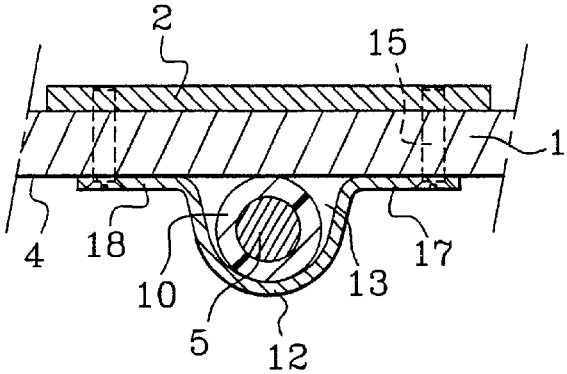
FIG. 2 is a view in longitudinal section of a detail of FIG. 1 in the region of the transverse spindle.

In the most simple form illustrated in FIG. 2, the spindle (5) is connected to the plate (12) by means of the elastic material (10) which is integrated with both the plate (12) and the spindle (5). The plate (12) is then fixed under the sole assembly (1). The boot can then be displaced in all directions within the deformation limits of the elastic element (10).

Figure 3:
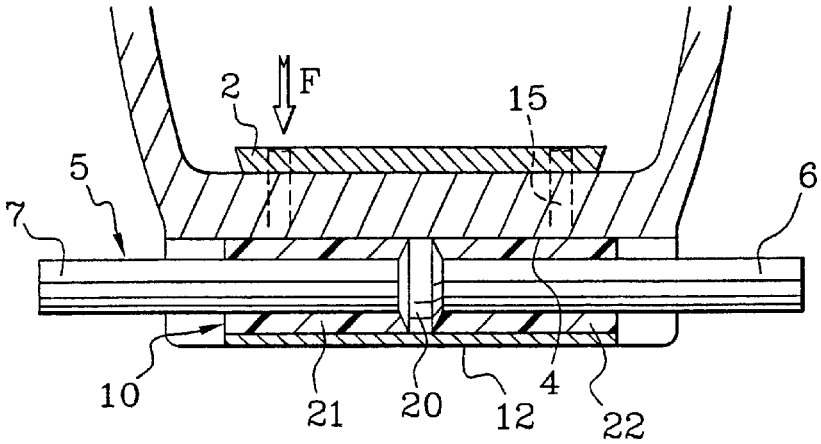
FIG. 3 is a view in cross section in the region of the transverse spindle of a boot made according to a variant of that in FIG. 1.

According to another characteristic of the invention illustrated in FIG. 3, the transverse spindle (5) comprises in its median region an enlargement (20) allowing it to come into contact with the lower face (4) of the outsole (1) and with the plate (12). In this way, the sheath (10) made of elastic material is divided into two parts (21, 22) located on either side of the enlargement (20).

During operation, when the boot is mounted on the binding, the ends (6, 7) of the transverse spindle (5) are held captively and constitute fixed points. The reinforcing piece (2) therefore has a degree of freedom in relation to the upper face of the board. In fact, when the user exerts a force F on one side of the reinforcing piece (2), for example when he inclines his leg laterally, that portion (21) of the elastic sheath located between the lower face (4) of the sole and the transverse spindle (5) tends to be compressed on the side where the forces are exerted. The zone of contact between the enlargement (20) and the lower face (4) of the outsole (1) forms a pivoting point about which the outsole (1) and also the reinforcing piece (2) tend to pivot. Thus, the opposite portion (22) of the elastic sheath tends to be stretched. It follows therefore that the reinforcing piece (2) is also inclined on the side where the forces are exerted, the result of which is therefore lateral deflection of the boot. Thus, while maintaining a particularly firm, effective attachment of the transverse spindle (5) and therefore of the boot, the latter has a degree of freedom allowing lateral inclination of the leg.

This deformation is accompanied by the crushing of the zone(s) of the outsole which come(s) into contact with the binding or the board. The lateral zones of the outsole located in front of and behind the recess (3) are therefore made from a relatively deformable material.

Moreover, this enlargement (20) ensures that a certain thickness of the elastic sheath (10) is maintained in the vicinity of the center of the spindle (5). This enlargement also carries out transmission of the forces exerted vertically from the boot to the spindle (5), and therefore to the binding. Thus, even when the user exerts great forces, resulting from his weight for example, the enlargement serves as a rocker and still allows lateral deflection of the boot. This arrangement proves to be particularly advantageous during fitting of the boot into the binding, as it allows the boot to be fitted in the binding without compression of the elastic element.

Figure 4:
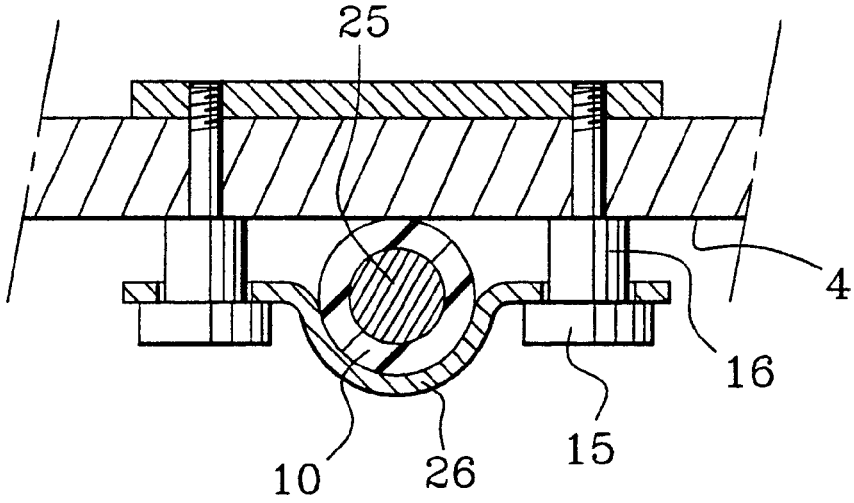
FIGS. 4 and 5 are views in longitudinal section of a detail of a sole made on variant embodiments of those illustrated in FIGS. 2 and 3.

In another variant likewise favoring the fitting of the boot into the binding illustrated in FIG. 4, the screws (15) for mounting the plate comprise smooth portions (16) allowing vertical sliding of the plate. This arrangement proves to be advantageous when fitting the boot into the binding. In fact, when the user brings the boot opposite the binding, the transverse spindle (25) comes into contact with the complementary arrangements of the binding. As the user exerts a downward force, the transverse spindle (25) therefore moves closer to the lower face (4) of the outsole. The sliding capacity of the plate (26) in relation to the sole makes it possible for the plate to follow the movement of the transverse spindle (25) and thus to avoid the elastic sheath (10) connecting the transverse spindle (25) and the plate (26) being excessively stretched.

Figure 5:
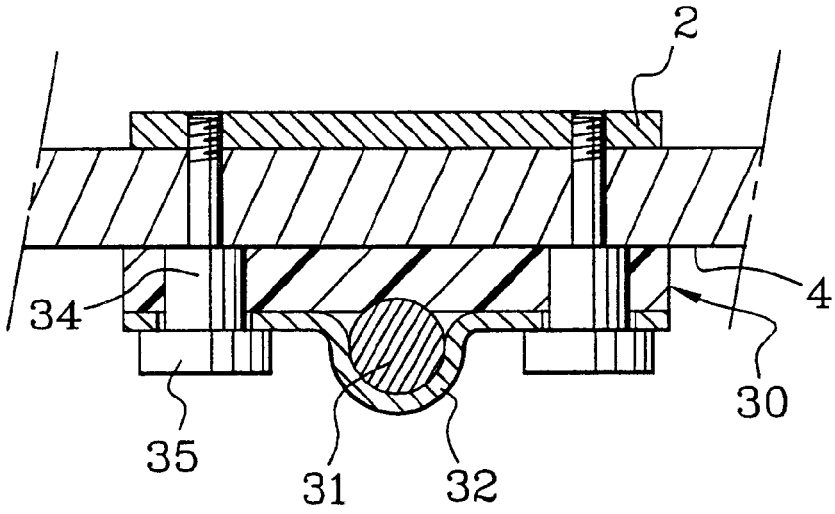

In a variant embodiment illustrated in FIG. 5, the element (30) made of elastic material can be interposed directly between the upper face of the transverse spindle (31) and the lower face (4) of the outsole (1).

In this case, the transverse spindle (31) and the plate (32) are integrated with one another, for example by welding or screwing. The plate (32) has openings (33) inside which a smooth part (34) of the screws (35) for fixing to the reinforcing piece (2) extends. By virtue of this sliding capacity of the plate (32) in relation to the fixing screws (35), the transverse spindle (32) has a displacement capacity. Thus, when the forces are exerted by the user on one side of the reinforcing piece (2), that portion of the elastic element (30) located directly under the zone of application of these forces is crushed, which therefore allows deflection of the boot.

It goes without saying that the spindle (31) can likewise comprise an enlargement similar to that illustrated in FIG. 3.

Second Mode of Embodying the Invention

Figure 6:
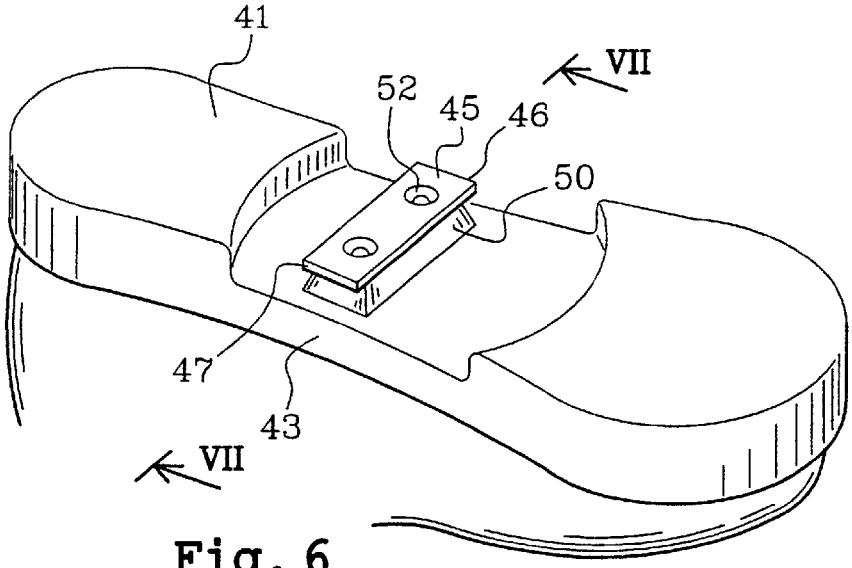
FIG. 6 is a basic perspective view of the sole of a boot including a transverse plate for interaction with the binding.
Figure 7:
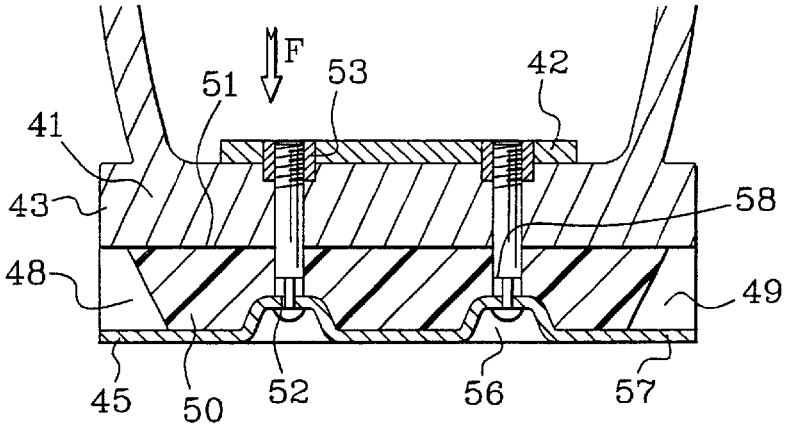
FIG. 7 is a view in cross section of FIG. 6.
Figure 8:
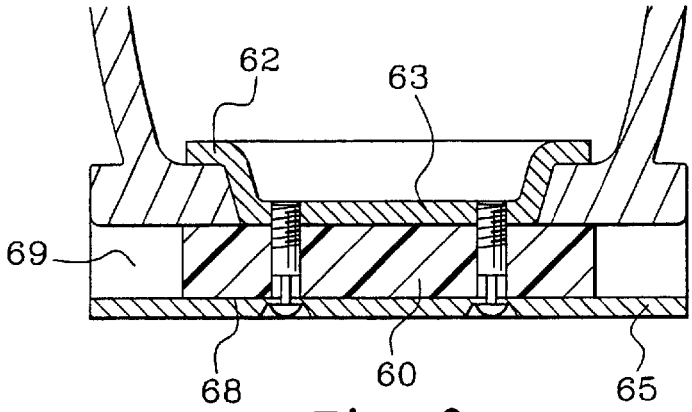
FIG. 8 is a view in cross section of a variant embodiment.

FIGS. 6 to 8 relate to boots equipped with another type of means for interaction with the binding, consisting of a transverse plate (45). Nevertheless, certain principles of operation set forth for the previous variant are likewise respected.

Thus, as illustrated in FIG. 6, the means for interaction with the binding consist of a transverse plate (45). This plate (45) has a length, measured in the longitudinal direction of the boot, of the order of a few centimeters. The dimension of the plate in the transverse direction corresponds essentially to the width of the sole (41). In this way, the lateral ends (46, 47) of this plate (45) are located directly under the lateral zones (43) of the sole (41). Located between the ends (46, 47) of this plate and the lower face (44) of the outsole are housings (48, 49) intended to receive the jaws or hooks of the binding (not shown). This type of interaction means has the advantage of not protruding laterally from the sole of the boot and therefore of facilitating walking.

The lower face of the outsole (41) receives an element (50) made of elastic material, such as natural or synthetic rubber, with a hardness between 30 Shore A and 60 Shore D, which itself comes into contact, via its upper face (51), with the outsole (41). This element (50) made of elastic material has a slightly pyramidal shape, making it possible to form lateral housings (48, 49) which are penetrated by the arrangements of the binding, while still having a sufficient volume of material to provide the desired elastic effect. Nevertheless, the invention is not limited to only this form of elastic element but covers other variants in terms of geometry.

This elastomeric element (50) can be an element added at the time the interaction plate is mounted. It can likewise be an integral part of the outsole and be molded with the latter.

The elastic element can likewise be partly inserted in a cavity (not shown) provided for this purpose under the outsole.

The transverse plate (45) comprises one or more opening (s) (52) allowing the passage of means (53) for connection to the reinforcing piece (42) which is integrated with the sole (41) of the boot. These openings (52) are made in indentations (56) sunk in the lower face (57) of the plate (45) in order to allow the accommodation of the connection means (53). These connection means (53) can be screws or any other similar means integrated with the reinforcing piece at the time the transverse plate is mounted. These connection means can likewise be downward extensions of the reinforcing piece (42) and comprise ends allowing the positioning of the transverse plate.

The openings (52) formed in the transverse plate (45) have a diameter which is sufficient to allow lateral displacement of the transverse plate (45) when the latter is inclined in relation to the lower face (44) of the outsole (41). The lower end (54) of the connection means (53) is sufficiently wide to interact with the bottom of the indentations (56) formed in the plate (45) and thus to prevent any displacement of the plate (45) below a certain level. In other words, when the boot is inclined laterally, a first zone of the elastic element (50) is compressed, while the other undergoes slight stretching. The connection means are therefore arranged so as to limit this stretching and to avoid any pulling off or at the very least the breakaway of the elastic element (50) in relation to the lower face of the sole.

Moreover, the connection means (53) comprise a shoulder (58), against which the upper face of the plate (45) abuts when the elastic element (50) is very compressed. The crushing of the elastic element is thus limited when the boot is greatly stressed, and in particular during fitting of the boot into the binding.

During operation, when the user exerts bearing forces F on one side of the reinforcing piece (42), for example by inclining his leg laterally, the connection means (53) located on the side of the forces slides inside the opening through which it extends, and that zone of the elastic element (50) located on this side is compressed. It follows that the reinforcing piece (42) is inclined in relation to the transverse plate (45) and therefore in relation to the upper face of the board.

As illustrated in FIG. 8, the reinforcing piece (62) can have such a shape that it extends downward to emerge under the outsole. In this case, the elastic element (60) is positioned under the protuberance (63) of the reinforcing piece (62). The plate (65) located under the elastic element (60) is anchored in the reinforcing piece (62) by means of screws which can advantageously comprise shoulders (68) identical to those described in FIG. 7. The shape of the protuberance (63) of the reinforcing piece (62) and the plate (65) define lateral housings (69) which are penetrated by the arrangements of the binding (not shown).

Although it is not shown explicitly in the drawings, the transverse plate can have an enlargement which allows it to pivot in relation to the sole assembly, after the fashion of the enlargement (30) illustrated in FIG. 3.

Figure 9:
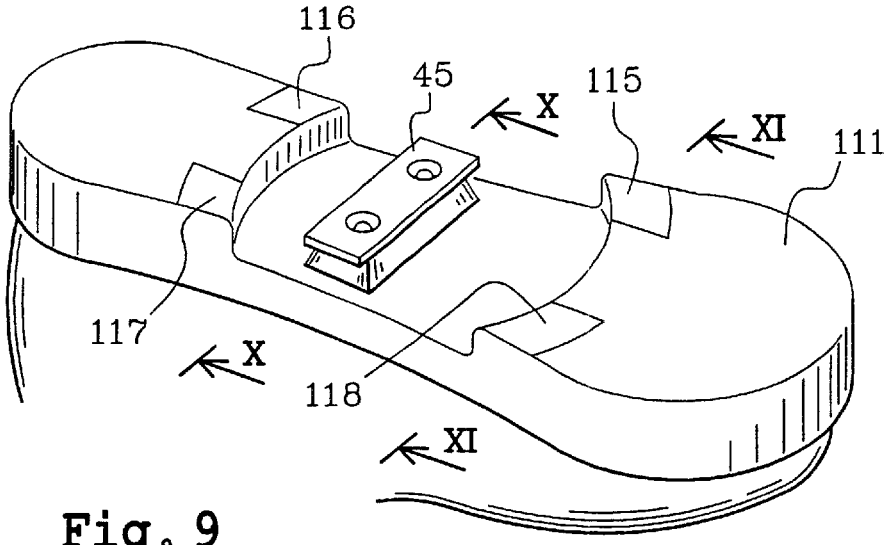
FIG. 9 is a basic perspective view of the sole of a boot according to another variant embodiment of a boot comprising a transverse plate for interaction with the binding.
Figure 10:
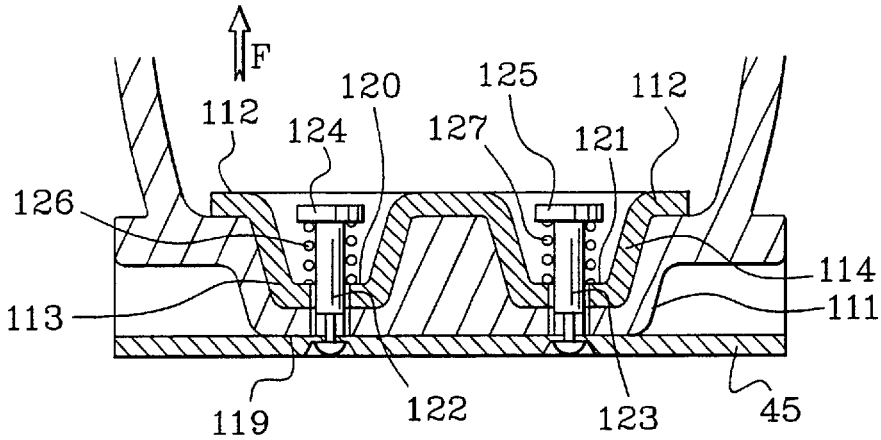
FIG. 10 is a view in cross section of FIG. 9.

FIGS. 9 and 10 illustrate a variant embodiment which functions on a particular type of boot, such as that described in document FR 2 786 371 of the Applicant. More specifically, this is a soft boot, the reinforcing piece (112) of which has protuberances extending down into the outsole (111). More specifically, and as illustrated in FIG. 9, the rigid reinforcement (112) has four zones extending through part of the thickness of the outsole (111) and coming close to the lower face of the latter. These protuberant zones form four projections (115–118), via which the bearing forces exerted by the user are transmitted effectively to the board. These projections come into contact with the board or the binding when the boot is held by the binding.

In this case, the rigidity of the reinforcement (112) prevents the outsole (111) from being deformed as for the variants described previously. The transverse plate (45) can therefore be displaced in relation to the outsole (111) under the tension forces generated, in particular when the user tilts his boot about a lateral ridge. More specifically, and as illustrated in FIG. 10, the reinforcement (112) has two portions (113, 114) descending close to the lower face (119) of the outsole (111). The bottom (120, 121) of these portions (113, 114) is perforated to allow passage of the connection means (122, 123) which extend through the outsole (111) and are anchored in the transverse plate (45). In their top part, the connection means comprise a stop (124, 125) for the top part of a spring (126, 127) working under compression. These springs (126, 127) also rest on the bottom (120, 121) of the protuberant zones (113, 114).

During operation, when the user tilts his leg laterally and his foot is raised on the left side, for example, as illustrated by the arrow F in FIG. 10, he exerts a vertical force which tends to lift the left side of the boot, and therefore the same left side of the reinforcement (112). As the transverse plate (45) is integrated with the binding, it follows that the spring (126) is compressed by the rising of the bottom (120) of the protuberant zone (113). This movement is possible in spite of the rigidity of the right side of the sole resulting from the presence of the projections (115, 116).

The shape of the protuberant zones (113, 114) can of course differ from that drawn in FIG. 10 so long as the reinforcement has a zone against which the spring can be compressed. The spring could be replaced by another elastic means, such as a projection made of elastomeric material, for example.

The mode of operation under tension described above can likewise be applied to other types of interaction means, such as in particular the transverse spindle described in FIGS. 1 to 5.

Figure 11:
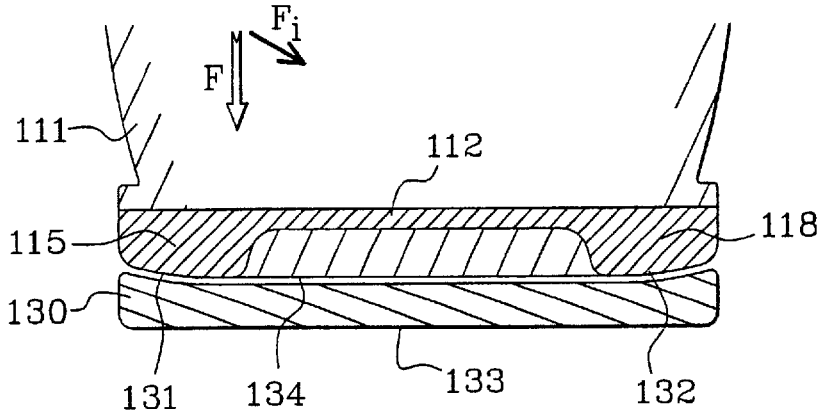
FIG. 11 is a view in section along the plane XI—XI of FIG. 9.

According to another characteristic of the invention illustrated in FIG. 11, which is applicable to the boots described above, the outsole (111) can have an upwardly oriented transverse curvature in the region of the bearing projections. In the opposite zone, the binding (130) has a similar curvature, so that the outsole (111) can be laterally displaced more easily, according to the rolling motion mentioned previously. The protuberant projections (115–118) located under the rigid reinforcement (112) have a lower face (131, 132) which is not parallel to the upper plane (133) of the board but is oriented according to the curvature of the lower face of the outsole (111). In this manner, when a vertical force F is exerted on one side of the boot, the component F⊥ parallel to the lower face (134) of the outsole (111) induces a slight transverse displacement contributing to the rolling motion.

Third Mode of Embodying the Invention

Figure 12:
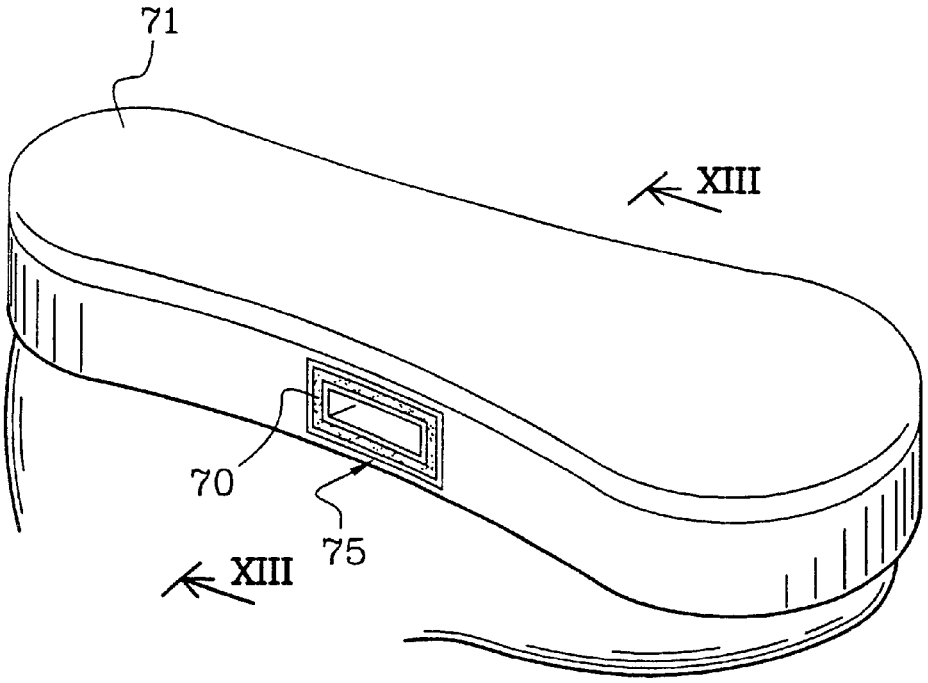
FIG. 12 is a basic perspective view of the bottom of a sole equipped with lateral inserts intended to interact with another type of binding.
Figure 13:
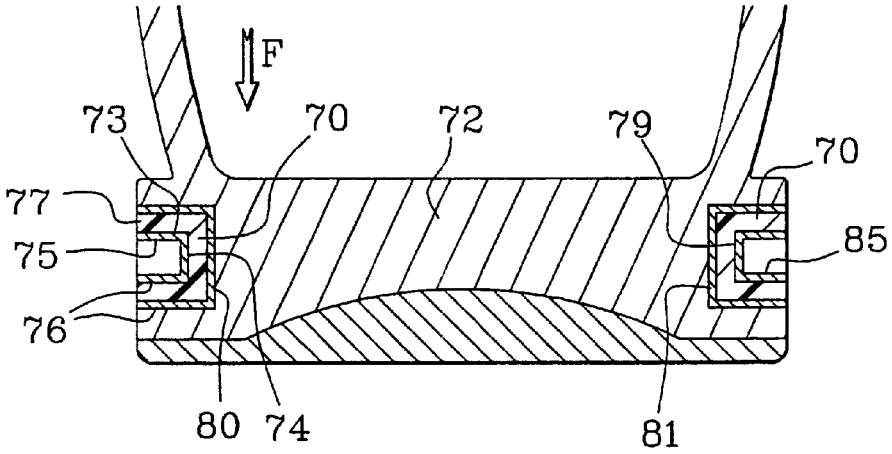
FIG. 13 is a view in cross section of FIG. 12 in the region of the inserts.

FIGS. 12 and 13 relate to boots equipped with another type of means for interaction with the binding, more particularly consisting of lateral inserts (75) accommodated in the thickness of the outsole (71).

Thus, as illustrated in FIG. 13, the outsole (71) of the boot comprises, roughly in the median region of its length, a reinforcing piece (72) which extends on both sides of the boot. This reinforcing piece (72) receives the foot of the user on its upper face (79). This reinforcing piece (72) receives two lateral inserts (75), one on each side. These inserts (75) consist of metal or plastic pieces which form a cavity of essentially parallelepipedal shape, having an opening (78)

arranged on the outer side of the sole (71). These inserts (75) are intended to receive the end of a jaw forming part of the binding (not shown).

These inserts (75) are accommodated inside a housing (79) formed in the element (70) made of elastic material which comes into contact with the insert (75) on all those faces of the latter located inside the volume of the outsole (71). Typically, the thickness of this element (70) made of elastic material is of the order of a few millimeters on the upper (73) and lower (76) faces of the insert (75) and of the order of 1 millimeter on the front and rear faces and on the inner face (74) of the insert (75).

The elements (70) made of elastic material are accommodated in a seat (80) consisting of a metal or plastic piece which follows the outer contour of the elastic element (70) on all those faces of the latter located inside the volume of the outsole (71). Nevertheless, in certain particular embodiments, this seat may be present on only the upper, inner and lower faces of the elastic element (70), to the exclusion of the front and rear faces of the latter. The two seats (80, 81) are each accommodated in the reinforcing piece (72) which is either embedded inside the outsole (71), as in the embodiment illustrated, or located above the latter inside the boot. In some cases, the elastic elements can be positioned directly in housings provided for this purpose on the sides of the reinforcing piece, without having recourse to the metal seats described above.

During operation, when the user exerts forces F on one side of the reinforcing piece (72), for example, this force is exerted downwardly on the corresponding seat (80). That part (77) of the elastic element (70) located between the upper face of the seat (80) and the upper face (73) of the insert (75) therefore tends to be compressed, and the seat (80) tends to descend in relation to the insert (75).

On the opposite side, the insert (85) performs an opposite movement in relation to the corresponding seat (81). This therefore results in the reinforcing piece (72) being inclined laterally in relation to the direction connecting the two inserts and therefore in relation to the board.

It is clear that in many cases only one side of the boot is stressed, for example upwardly under tension, and in this case the other side is not necessarily deformed. Similarly, the possibility can be observed of compression or tension of those portions of the elastic element located at the bottom of the seats, which affords the possibility of obtaining a certain lateral displacement and therefore the rolling motion sought.

Fourth Mode of Embodying the Invention

Figure 14:
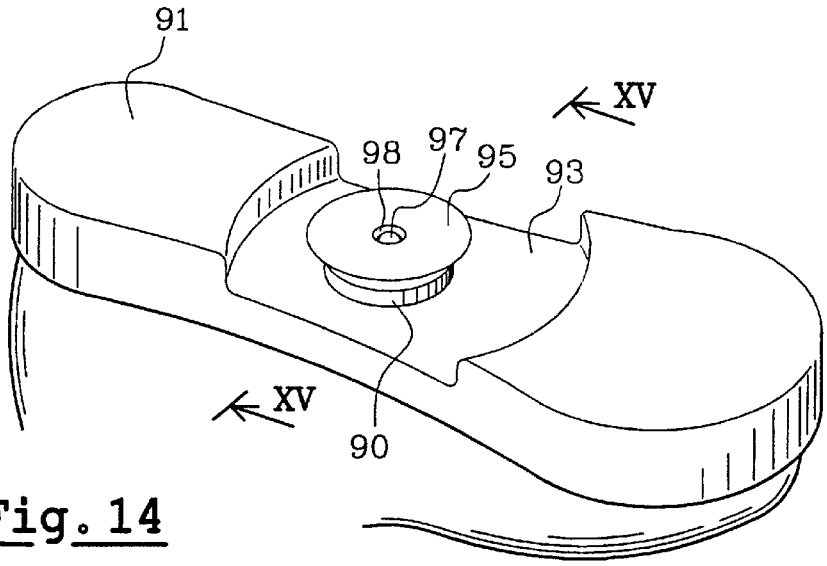
FIG. 14 is a basic perspective view of the bottom of a sole equipped with a central projection for interaction with the binding.
Figure 15:
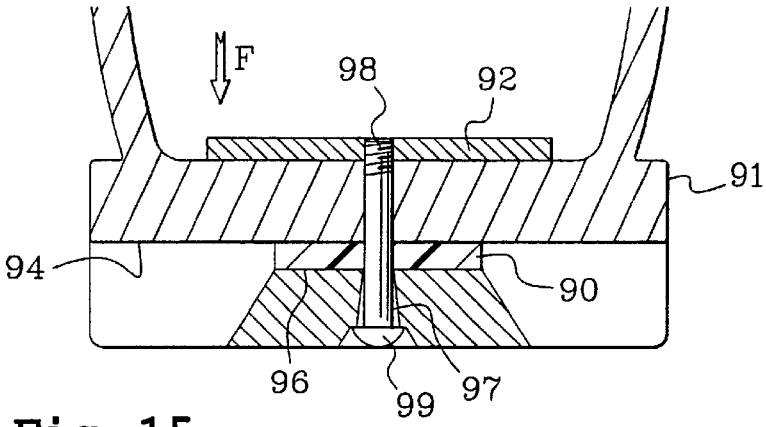
FIG. 15 is a view in cross section of FIG. 14 in the region of the interaction projection.
Figure 16:
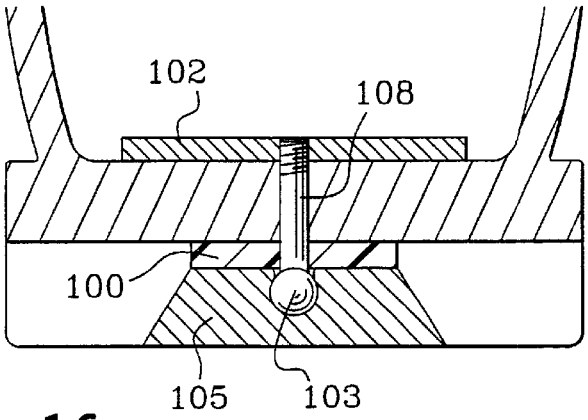
FIG. 16 is a view in section of a variant embodiment.

The boot according to the invention can likewise be equipped with another type of interaction means such as that illustrated in FIGS. 14 to 16. This type of interaction means comprises a rigid projection (95) of essentially frustoconical or similar shape which is located in the median region of the boot, at the site of the clearance (93) of the plantar arch. Such a projection (95) interacts with jaws of a binding (not shown) which engage the projection (95) captively by contact with the contour of the latter.

According to the invention, the upper face (96) of this projection (95) comes into contact with the lower face (97) of an element (90) made of elastic material which itself comes into contact with the lower face (94) of the outsole (91). The shape of the elastic element (90) can be variable depending on that of the projection (95). This element can therefore have, for example, a cylindrical shape, resting on the upper face (96) of the projection (95). In a variant which is not shown, this projection can likewise be partly accommodated in a housing provided for this purpose under the outsole (91). This projection can likewise form an integral part of the outsole, constituting a downward extension obtained using multi-injection techniques.

As illustrated in FIGS. 14 and 15, the projection (95) has in the center of its lower face a through-opening (97), in which a connection means (98) of the screw type or similar is positioned. This connection means (98) extends through the elastic element (90) and the outsole (91) to the reinforcing piece (92), in which it is firmly integrated. To allow slight displacement of the projection (95) in relation to the connection means (98), the opening (97) formed in the projection (95) has a diverging downwardly open profile. In this case, the opening (97) has a shoulder, in which the head (99) of the screw (98) forming the connection means can fit. The diameter of this head and the dimensions of the shoulder are determined so as to allow sufficient movement of the projection (95) in relation to the connection means (98) while serving to hold the latter in relation to the boot.

In a variant which is not shown, the connection means can consist of an extension of the reinforcing piece which extends through the outsole, the elastic element and the projection.

During operation, when the user exerts forces F on one side of the reinforcing piece (92), these are transmitted by the outsole (91) to one side of the elastic element (90) which is compressed between the outsole (91) and the upper face (96) of the projection (95) which is fixed in relation to the board.

In this case, the connection means (98) is displaced inside the opening (97) formed in the projection (95), and the boot is therefore inclined laterally.

In another embodiment illustrated in FIG. 16, the connection means (108) integrated with the reinforcing piece (102) comprises at its lower end a ball joint (103) interacting with the projection (105). Thus, when forces are exerted by the user on the reinforcing piece (102), and these are not parallel to the connection means (108), the latter pivots in relation to the projection (105), bringing about the crushing of one side of the elastic element (100). The boot therefore undergoes the lateral movement sought. The position of the ball joint or more generally of the point of pivoting between the connection means and the projection can be different from that illustrated in FIG. 15 without leaving the scope of the invention.

In this case also, the elastic element works under compression/tension and by shear in the horizontal direction as well, which makes it possible to obtain the rolling motion sought.

It is clear from the above that the boots according to the invention have multiple advantages and in particular afford the possibility of allowing:

- a rolling motion of the boot in relation to the binding, while providing firm, effective holding in relation to the binding;
- a return to the rest position favored by the presence of an elastic element;
- the possibility of absorbing a certain amount of the vibrations by the use of a damping elastic material.

What is claimed is:

1. Snowboarding boot comprising a sole assembly comprising:

an outsole, comprising a lower face for contacting a ground surface;

a reinforcing piece;

means for interaction with complementary arrangements of a binding of a snowboard, said means being mechanically integrated with the sole assembly; and an elastic element interposed between the interaction means and the sole assembly, said element being elastically deformable to allow lateral deflection of the boot relative to the binding to cause opposite lateral ridges of the boot to be displaced at different distances from the snowboard.

2. Boot according to claim 1, wherein the deformation of the elastic element takes place by compression or tension in a vertical direction, and by shear in a horizontal plane.

3. Boot according to claim 1, wherein the elastic element has an asymmetric deformation capacity which is different from one side of the boot to the other.

4. Boot according to claim 1, further comprising means for limiting asymmetrically the lateral deflection of the boot.

5. Boot according to claim 1, wherein the interaction means are anchored in the reinforcing piece.

6. Boot according to claim 1, wherein the elastic element consists of a zone of the outsole.

7. Boot according to claim 1, wherein the elastic element is interposed between the outsole and the interaction means.

8. Boot according to claim 1, further comprising means for limiting the displacement of the interaction means in relation to the reinforcing piece.

9. Boot according to claim 1, characterized in that the element (10) interposed between the reinforcing piece (2) and the interaction means (5) has viscoelastic properties.

10. Boot according to claim 1, wherein the interaction means comprise a transverse plate, the ends of which are configured to come into contact with the binding.

11. Boot according to claim 10, further comprising connection means extending through the plate and anchored in the reinforcing piece, said plate being configured to slide relative to said connection means.

12. Boot according to claim 1, wherein the elastic element interposed between the interaction means and the sole assembly is formed by at least one spring working under compression.

13. The boot of claim 1 wherein said lateral ridges of the boot comprise lateral zones of said outsole.

14. The boot of claim 1 wherein said means for interaction is configured to incline in a transverse direction relative to the ski due to the lateral deflection of the boot.

15. The boot of claim 1 wherein said elastic element comprises lateral portions which are configured to be at least one of compressed and stretched to allow said opposite lateral ridges of the boot to be displaced at different distances from the snowboard.

16. Snowboarding boot comprising a sole assembly comprising:

an outsole, comprising a lower face for contacting a ground surface;

a reinforcing piece;

means for interaction with complementary arrangements of a binding of a snowboard, said interaction means comprising a transverse plate mechanically integrated with the sole assembly, ends of said plate being configured to come into contact with the binding;

an elastic element interposed between the interaction means and the sole assembly, said element being elastically deformable to allow lateral deflection of the boot relative to the binding; and connection means extending through the plate and anchored in the reinforcing piece, said plate being configured to slide relative to said connection means.

17. Snowboarding boot comprising a sole assembly comprising:

an outsole, comprising a lower face for contacting a ground surface;

a reinforcing piece;

means for interaction with complementary arrangements of a binding of a snowboard, said means being mechanically integrated with the sole assembly; and an elastic element interposed between the interaction means and the sole assembly, said element being elastically deformable to allow lateral deflection of the boot relative to the binding to cause an inclination of said means for interaction in a transverse direction relative to the snowboard.

18. The boot of claim 17 wherein said means for interaction comprises a transverse plate.

* * * * *